US009174323B2

(12) United States Patent
Van Berkel et al.

(10) Patent No.: US 9,174,323 B2
(45) Date of Patent: Nov. 3, 2015

(54) COMBINATORIAL TOOL FOR MECHANICALLY-ASSISTED SURFACE POLISHING AND CLEANING

(71) Applicant: Intermolecular, Inc., San Jose, CA (US)

(72) Inventors: Kim Van Berkel, Mountain View, CA (US); Aaron T. Francis, San Jose, CA (US); Frank C. Ma, Scotts Valley, CA (US); George Mirth, Saratoga, CA (US)

(73) Assignee: Intermolecular, Inc., San Jose, CA (US)

( * ) Notice: Subject to any disclaimer, the term of this patent is extended or adjusted under 35 U.S.C. 154(b) by 306 days.

(21) Appl. No.: 13/671,478

(22) Filed: Nov. 7, 2012

(65) Prior Publication Data

US 2014/0127974 A1 May 8, 2014

(51) Int. Cl.
*B24B 37/26* (2012.01)
*B24B 37/10* (2012.01)

(52) U.S. Cl.
CPC ..... *B24B 37/26* (2013.01); *B24B 37/10* (2013.01)

(58) Field of Classification Search
CPC ..... B24B 37/00; B24B 37/26; B24B 37/10
USPC ..... 451/28, 103, 177, 360
See application file for complete search history.

(56) References Cited

U.S. PATENT DOCUMENTS

| | | | | |
|---|---|---|---|---|
| 4,391,013 | A * | 7/1983 | Janssen | 15/210.1 |
| 5,569,062 | A * | 10/1996 | Karlsrud | 451/285 |
| 6,254,718 | B1 * | 7/2001 | Tanaka et al. | 156/345.12 |
| 6,299,506 | B2 * | 10/2001 | Nishimura et al. | 451/8 |
| 6,857,950 | B2 * | 2/2005 | Hayashi et al. | 451/397 |
| 7,785,172 | B2 | 8/2010 | Satitpunwaycha et al. | |
| 2003/0114087 | A1 * | 6/2003 | Duboust et al. | 451/41 |
| 2004/0053562 | A1 * | 3/2004 | Petroski et al. | 451/41 |
| 2009/0047881 | A1 * | 2/2009 | Satitpunwaycha et al. | 451/291 |
| 2009/0191800 | A1 * | 7/2009 | Rivard et al. | 451/466 |

* cited by examiner

*Primary Examiner* — Lee D Wilson
*Assistant Examiner* — Joel Crandall

(57) ABSTRACT

Polishing and cleaning techniques are combinatorially processed and evaluated. A polishing system can include a reactor assembly having multiple reaction chambers, with at least a reaction chamber including a rotatable polishing head, slurry and chemical distribution, chemical and water rinse, and slurry and fluid removal. Different downward forces can be applied to the polishing heads for evaluating optimum process conditions. Channels in the polishing pads can redistribute slurry and chemical to the polishing area.

15 Claims, 13 Drawing Sheets

COMBINATORIAL TOOL FOR MECHANICALLY-ASSISTED SURFACE POLISHING AND CLEANING

FIELD OF THE INVENTION

The present invention relates generally to combinatorial methods for device process development.

BACKGROUND OF THE INVENTION

The manufacture of advanced semiconductor devices entails the integration and sequencing of many unit processing steps, with potential new material and process developments. The precise sequencing and integration of the unit processing steps enables the formation of functional devices meeting desired performance metrics such as power efficiency, signal propagation, and reliability.

As part of the discovery, optimization and qualification of each unit process, it is desirable to be able to i) test different materials, ii) test different processing conditions within each unit process module, iii) test different sequencing and integration of processing modules within an integrated processing tool, iv) test different sequencing of processing tools in executing different process sequence integration flows, and combinations thereof in the manufacture of devices such as integrated circuits. In particular, there is a need to be able to test i) more than one material, ii) more than one processing condition, iii) more than one sequence of processing conditions, iv) more than one process sequence integration flow, and combinations thereof, collectively known as "combinatorial process sequence integration", on a single monolithic substrate without the need of consuming the equivalent number of monolithic substrates per material(s), processing condition(s), sequence(s) of processing conditions, sequence(s) of processes, and combinations thereof. This can greatly improve both the speed and reduce the costs associated with the discovery, implementation, optimization, and qualification of material(s), process(es), and process integration sequence(s) required for manufacturing.

HPC processing techniques have been used in wet chemical processing such as etching and cleaning. HPC processing techniques have also been used in deposition processes such as physical vapor deposition (PVD), atomic layer deposition (ALD), and chemical vapor deposition (CVD). However, currently there are no systems for chemical mechanical polishing (CMP) multiple site isolated regions on a substrate. Therefore there is a need for combinatorially chemical mechanical polishing isolated surface regions on a substrate.

SUMMARY OF THE DESCRIPTION

In some embodiments, the invention discloses chemical mechanical polishing (CMP) an isolated region of a substrate. A flow cell can include a rotatable head for planarizing or cleaning the portion of the substrate defined by the chamber wall of the flow cell. The downward pressure on the rotatable head can be controlled by added weights to the shaft of the rotatable head, by a spring loading system with adjustable shaft length, or spring or pneumatic force through a variety of mechanisms such as a piston or bellow, or by electromagnetic force. The downward pressure on each rotatable head can be individually adjustable, allowing combinatorial testing of different mechanical down force in deposition, polishing and cleaning applications.

In some embodiments, the rotatable head can include interchangeable pads, which have materials appropriate for different applications. For example, a polyurethane pad can be used for CMP, and a poly(vinyl alcohol) pad can be used for cleaning and particle removal.

In some embodiments, different pads can be installed on different rotatable heads, and the flow cells can move between isolated regions to perform different actions. For example, a flow cell can include a CMP pad mounted on a rotatable head, which can polish an isolated region of the substrate. After the polishing is completed, a different flow cell, including a cleaning pad mounted on a rotatable head, can move to the isolated region for cleaning the isolated region.

In some embodiments, the surface of the pads contacting the substrate surface can be customized for specific applications. For example, a channel included in the pad surface can allow the exposure of chemistry to the area under the rotatable head, resulting in a uniform polishing or cleaning action.

In some embodiments, the present invention discloses systems and methods for combinatorially chemical mechanical polishing (CMP), cleaning, and evaluating multiple isolated regions on a substrate. The CMP process is capable of providing localized planarization surfaces to multiple isolated regions in a combinatorial manner. Accordingly, from a single substrate, a variety of materials, process conditions, and process sequences may be evaluated for desired planarization results.

BRIEF DESCRIPTION OF THE DRAWINGS

To facilitate understanding, identical reference numerals have been used, where possible, to designate identical elements that are common to the figures. The drawings are not to scale and the relative dimensions of various elements in the drawings are depicted schematically and not necessarily to scale.

The techniques of the present invention can readily be understood by considering the following detailed description in conjunction with the accompanying drawings, in which.

DETAILED DESCRIPTION OF THE PREFERRED EMBODIMENTS

Figure 1:
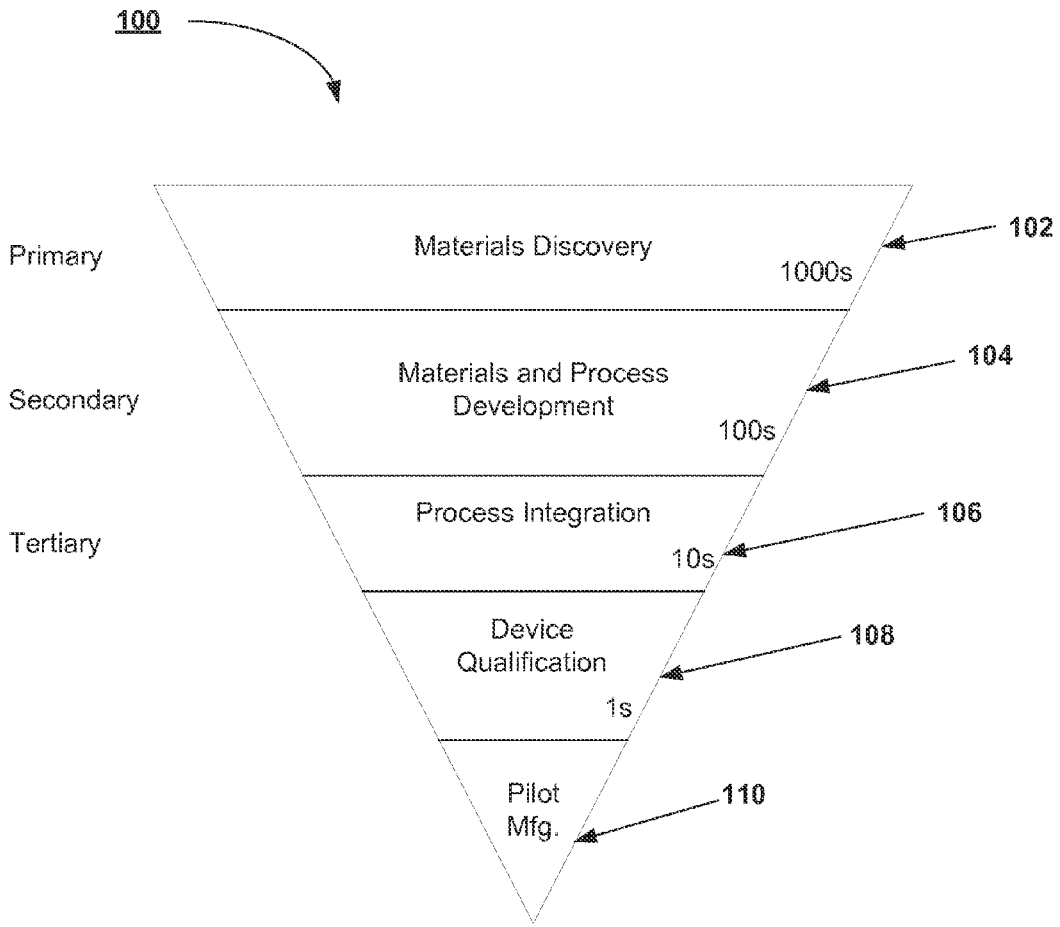
FIG. 1 illustrates a schematic diagram for implementing combinatorial processing and evaluation using primary, secondary, and tertiary screening.

A detailed description of one or more embodiments is provided below along with accompanying figures. The detailed description is provided in connection with such embodiments, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For the purpose of clarity, technical material that is known in the technical fields related to the embodiments has not been described in detail to avoid unnecessarily obscuring the description.

The present invention relates to systems and methods for polishing and cleaning isolated surface regions of a substrate during a wet processing of the remaining surface. In some embodiments, the present invention discloses methods and systems for use in high productivity combinatorial processes.

In some embodiments, the present invention discloses systems and methods for combinatorially chemical mechanical polishing (CMP) and evaluating multiple isolated regions on a substrate. The CMP process is capable of providing localized planarization surfaces to multiple site isolated regions in a combinatorial manner. Accordingly, from a single substrate, a variety of materials, process conditions, and process sequences may be evaluated for desired planarization results.

In some embodiments, the invention discloses chemical mechanical polishing (CMP) a site isolated region of a substrate. In some embodiments, a flow cell can include a rotatable polishing head for planarizing the portion of the substrate defined by the chamber wall of the flow cell. The flow cell can further include inlet conduits for introducing slurry, chemicals, and water rinse, and outlet conduits for removing materials, such as slurry waste or rinse liquid waste, from the site isolated surface region.

In some embodiments, the invention discloses methods for CMP a site isolated region of a substrate, including wetting the site isolated region before disposing a polishing head, polishing the site isolated region while flowing slurry on another area of the site isolated region, and rinsing the site isolated region after completed planarizing.

"Combinatorial Processing" generally refers to techniques of differentially processing multiple regions of one or more substrates. Combinatorial processing generally varies materials, unit processes or process sequences across multiple regions on a substrate. The varied materials, unit processes, or process sequences can be evaluated (e.g., characterized) to determine whether further evaluation of certain process sequences is warranted or whether a particular solution is suitable for production or high volume manufacturing.

Systems and methods for High Productivity Combinatorial (HPC) processing are described in U.S. Pat. No. 7,544,574 filed on Feb. 10, 2006, U.S. Pat. No. 7,824,935 filed on Jul. 2, 2008, U.S. Pat. No. 7,871,928 filed on May 4, 2009, U.S. Pat. No. 7,902,063 filed on Feb. 10, 2006, and U.S. Pat. No. 7,947,531 filed on Aug. 28, 2009 which are all herein incorporated by reference. Systems and methods for HPC processing are further described in U.S. patent application Ser. No. 11/352,077 filed on Feb. 10, 2006, claiming priority from Oct. 15, 2005, U.S. patent application Ser. No. 11/419,174 filed on May 18, 2006, claiming priority from Oct. 15, 2005, U.S. patent application Ser. No. 11/674,132 filed on Feb. 12, 2007, claiming priority from Oct. 15, 2005, and U.S. patent application Ser. No. 11/674,137 filed on Feb. 12, 2007, claiming priority from Oct. 15, 2005 which are all herein incorporated by reference.

FIG. 1 illustrates a schematic diagram, 100, for implementing combinatorial processing and evaluation using primary, secondary, and tertiary screening. The schematic diagram, 100, illustrates that the relative number of combinatorial processes run with a group of substrates decreases as certain materials and/or processes are selected. Generally, combinatorial processing includes performing a large number of processes during a primary screen, selecting promising candidates from those processes, performing the selected processing during a secondary screen, selecting promising candidates from the secondary screen for a tertiary screen, and so on. In addition, feedback from later stages to earlier stages can be used to refine the success criteria and provide better screening results.

For example, thousands of materials are evaluated during a materials discovery stage, 102. Materials discovery stage, 102, is also known as a primary screening stage performed using primary screening techniques. Primary screening techniques may include dividing substrates into coupons and depositing materials using varied processes. The materials are then evaluated, and promising candidates are advanced to the secondary screen, or materials and process development stage, 104. Evaluation of the materials is performed using metrology tools such as electronic testers and imaging tools (i.e., microscopes).

The materials and process development stage, 104, may evaluate hundreds of materials (i.e., a magnitude smaller than the primary stage) and may focus on the processes used to deposit or develop those materials. Promising materials and processes are again selected, and advanced to the tertiary screen or process integration stage, 106, where tens of materials and/or processes and combinations are evaluated. The tertiary screen or process integration stage, 106, may focus on integrating the selected processes and materials with other processes and materials.

The most promising materials and processes from the tertiary screen are advanced to device qualification, 108. In device qualification, the materials and processes selected are evaluated for high volume manufacturing, which normally is conducted on full substrates within production tools, but need not be conducted in such a manner. The results are evaluated to determine the efficacy of the selected materials and processes. If successful, the use of the screened materials and processes can proceed to pilot manufacturing, 110.

The schematic diagram, 100, is an example of various techniques that may be used to evaluate and select materials and processes for the development of new materials and processes. The descriptions of primary, secondary, etc. screening and the various stages, 102-110, are arbitrary and the stages may overlap, occur out of sequence, be described and be performed in many other ways.

This application benefits from High Productivity Combinatorial (HPC) techniques described in U.S. patent application Ser. No. 11/674,137 filed on Feb. 12, 2007 which is hereby incorporated for reference in its entirety. Portions of the '137 application have been reproduced below to enhance the understanding of the present invention. The embodiments described herein enable the application of combinatorial techniques to process sequence integration in order to arrive at a globally optimal sequence of device fabrication processes by considering interaction effects between the unit manufacturing operations, the process conditions used to effect such unit manufacturing operations, hardware details used during the processing, as well as materials characteristics of components utilized within the unit manufacturing operations. Rather than only considering a series of local optimums, i.e., where the best conditions and materials for each manufacturing unit operation is considered in isolation, the embodiments described below consider interactions effects introduced due to the multitude of processing operations that are performed and the order in which such multitude of processing operations are performed. A global optimum sequence order is therefore derived, and as part of this derivation, the unit processes, unit process parameters and materials used in the unit process operations of the optimum sequence order are also considered.

The embodiments described further analyze a portion or sub-set of the overall process sequence used to manufacture a semiconductor device. Once the subset of the process sequence is identified for analysis, combinatorial process sequence integration testing is performed to optimize the materials, unit processes, hardware details, and process sequence used to build that portion of the device or structure. During the processing of some embodiments described herein, structures are formed on the processed substrate which are equivalent to the structures formed during actual production of the device. For example, such structures may include, but would not be limited to, gate dielectric layers, gate electrode layers, spacers, or any other series of layers or unit processes that create an intermediate structure found on semiconductor devices. While the combinatorial processing varies certain materials, unit processes, hardware details, or process sequences, the composition or thickness of the layers or structures or the action of the unit process, such as cleaning, surface preparation, deposition, surface treatment, etc. is substantially uniform through each discrete region. Furthermore, while different materials or unit processes may be used for corresponding layers or steps in the formation of a structure in different regions of the substrate during the combinatorial processing, the application of each layer or use of a given unit process is substantially consistent or uniform throughout the different regions in which it is intentionally applied. Thus, the processing is uniform within a region (inter-region uniformity) and between regions (intra-region uniformity), as desired. It should be noted that the process can be varied between regions, for example, where a thickness of a layer is varied or a material may be varied between the regions, etc., as desired by the design of the experiment.

The result is a series of regions on the substrate that contain structures or unit process sequences that have been uniformly applied within that region and, as applicable, across different regions. This process uniformity allows comparison of the properties within and across the different regions such that the variations in test results are due to the varied parameter (e.g., materials, unit processes, unit process parameters, hardware details, or process sequences) and not the lack of process uniformity. In the embodiments described herein, the positions of the discrete regions on the substrate can be defined as needed, but are preferably systematized for ease of tooling and design of experimentation. In addition, the number, variants and location of structures within each region are designed to enable valid statistical analysis of the test results within each region and across regions to be performed.

Figure 2:
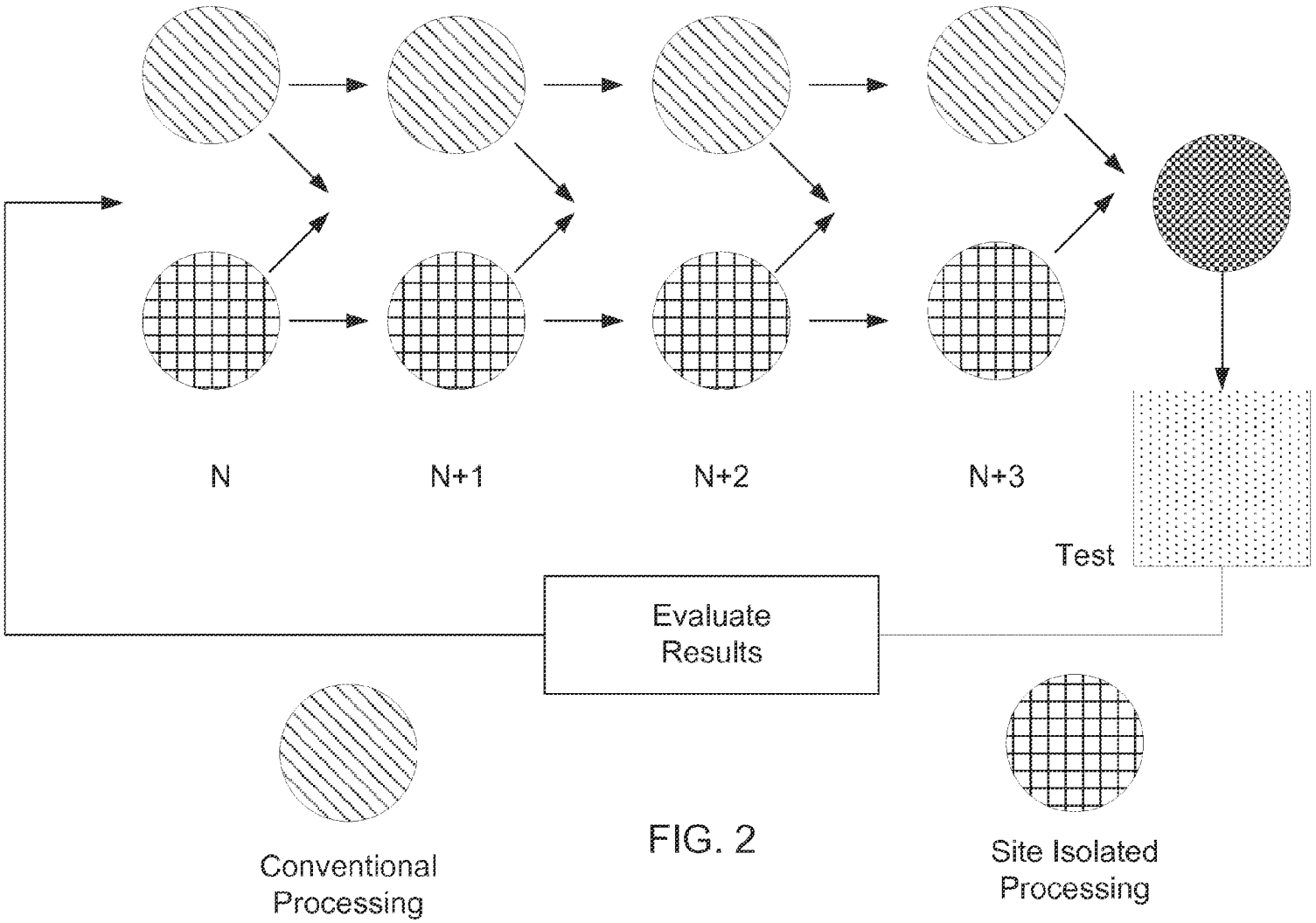
FIG. 2 is a simplified schematic diagram illustrating a general methodology for combinatorial process sequence integration that includes site isolated processing and/or conventional processing in accordance with one embodiment of the invention.

FIG. 2 is a simplified schematic diagram illustrating a general methodology for combinatorial process sequence integration that includes site isolated processing and/or conventional processing in accordance with one embodiment of the invention. In one embodiment, the substrate is initially processed using conventional process N. In one exemplary embodiment, the substrate is then processed using site isolated process N+1. During site isolated processing, an HPC module may be used, such as the HPC module described in U.S. patent application Ser. No. 11/352,077 filed on Feb. 10, 2006. The substrate can then be processed using site isolated process N+2, and thereafter processed using conventional process N+3. Testing is performed and the results are evaluated. The testing can include physical, chemical, acoustic, magnetic, electrical, optical, etc. tests. From this evaluation, a particular process from the various site isolated processes (e.g. from steps N+1 and N+2) may be selected and fixed so that additional combinatorial process sequence integration may be performed using site isolated processing for either process N or N+3. For example, a next process sequence can include processing the substrate using site isolated process N, conventional processing for processes N+1, N+2, and N+3, with testing performed thereafter.

It should be appreciated that various other combinations of conventional and combinatorial processes can be included in the processing sequence with regard to FIG. 2. That is, the combinatorial process sequence integration can be applied to any desired segments and/or portions of an overall process flow. Characterization, including physical, chemical, acoustic, magnetic, electrical, optical, etc. testing, can be performed after each process operation, and/or series of process operations within the process flow as desired. The feedback provided by the testing is used to select certain materials, processes, process conditions, and process sequences and eliminate others. Furthermore, the above flows can be applied to entire monolithic substrates, or portions of monolithic substrates such as coupons.

Under combinatorial processing operations the processing conditions at different regions can be controlled independently. Consequently, process material amounts, reactant species, processing temperatures, processing times, processing pressures, processing flow rates, processing powers, processing reagent compositions, the rates at which the reactions are quenched, deposition order of process materials, process sequence steps, hardware details, etc., can be varied from region to region on the substrate. Thus, for example, when exploring materials, a processing material delivered to a first and second region can be the same or different. If the processing material delivered to the first region is the same as the processing material delivered to the second region, this processing material can be offered to the first and second regions on the substrate at different concentrations. In addition, the material can be deposited under different processing parameters. Parameters which can be varied include, but are not limited to, process material amounts, reactant species, processing temperatures, processing times, processing pressures, processing flow rates, processing powers, processing reagent compositions, the rates at which the reactions are quenched, atmospheres in which the processes are conducted, an order in which materials are deposited, hardware details of the gas distribution assembly, etc. It should be appreciated that these process parameters are exemplary and not meant to be an exhaustive list as other process parameters commonly used in semiconductor manufacturing may be varied.

As mentioned above, within a region, the process conditions are substantially uniform, in contrast to gradient processing techniques which rely on the inherent non-uniformity of the material deposition. That is, the embodiments, described herein locally perform the processing in a conventional manner, e.g., substantially consistent and substantially uniform, while globally over the substrate, the materials, processes, and process sequences may vary. Thus, the testing will find optimums without interference from process variation differences between processes that are meant to be the same. It should be appreciated that a region may be adjacent to another region in one embodiment or the regions may be isolated and, therefore, non-overlapping. When the regions are adjacent, there may be a slight overlap wherein the materials or precise process interactions are not known, however, a portion of the regions, normally at least 50% or more of the area, is uniform and all testing occurs within that region. Further, the potential overlap is only allowed with material of processes that will not adversely affect the result of the tests. Both types of regions are referred to herein as regions or discrete regions.

Combinatorial processing can be used to produce and evaluate different materials, chemicals, processes, process and integration sequences, and techniques related to semiconductor fabrication. For example, combinatorial processing can be used to determine optimal processing parameters (e.g., power, time, reactant flow rates, temperature, etc.) of dry processing techniques such as dry etching (e.g., plasma etching, flux-based etching, reactive ion etching (RIE)) and dry deposition techniques (e.g., physical vapor deposition (PVD), chemical vapor deposition (CVD), atomic layer deposition (ALD), etc.). Combinatorial processing can be used to determine optimal processing parameters (e.g., time, concentration, temperature, stirring rate, etc.) of wet processing techniques such as wet etching, wet cleaning, rinsing, and wet deposition techniques (e.g., electroplating, electroless deposition, chemical bath deposition, etc.).

Figure 3:
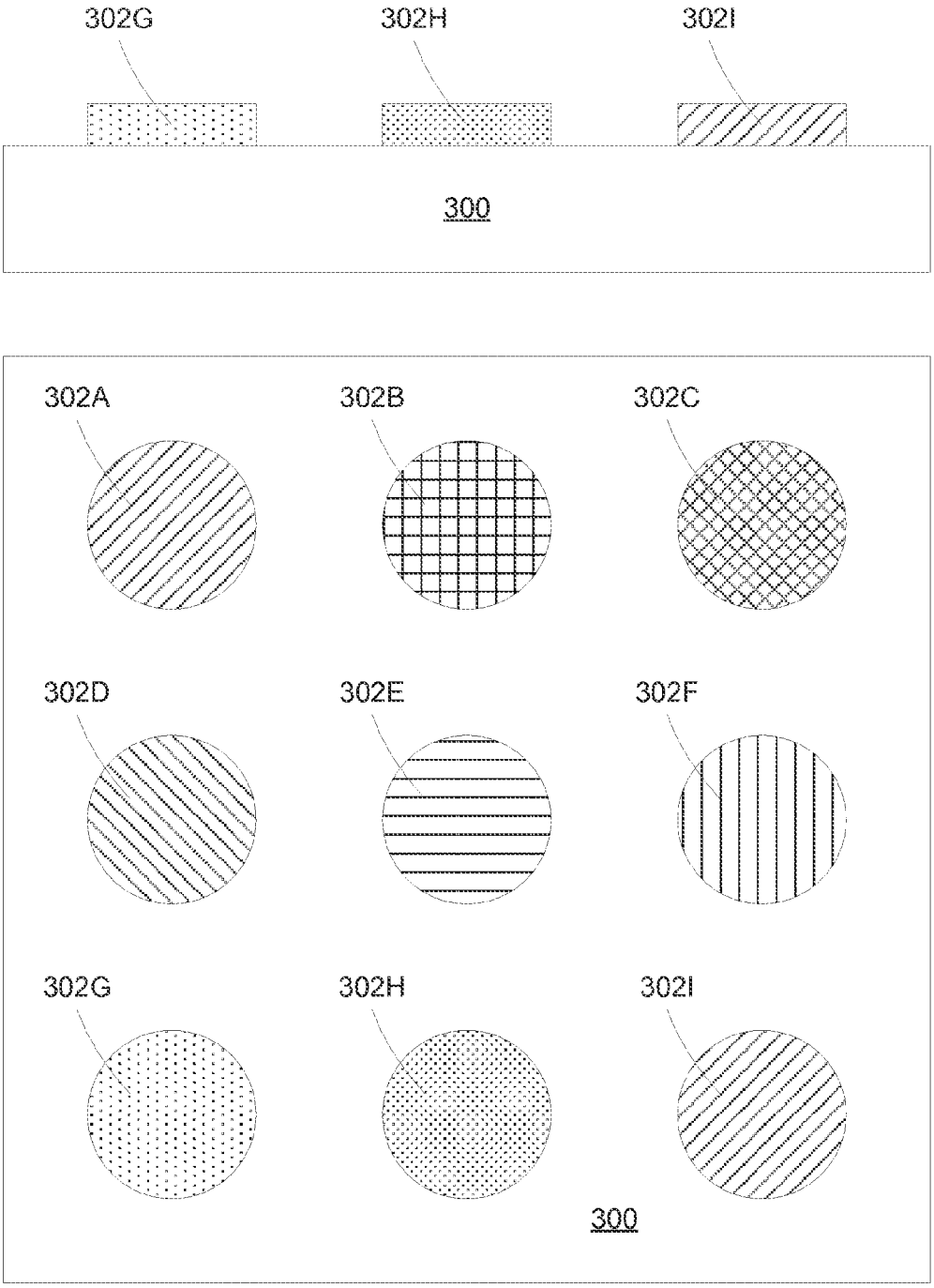
FIG. 3 illustrates a schematic diagram of a substrate that has been processed in a combinatorial manner.

FIG. 3 illustrates a schematic diagram of a substrate that has been processed in a combinatorial manner. A substrate, 300, is shown with nine site isolated regions, 302A-302I, illustrated thereon. Although the substrate 300 is illustrated as being a generally square shape, those skilled in the art will understand that the substrate may be any useful shape such as round, rectangular, etc. The lower portion of FIG. 3 illustrates a top down view while the upper portion of FIG. 3 illustrates a cross-sectional view taken through the three site isolated regions, 302G-302I. The shading of the nine site isolated regions illustrates that the process parameters used to process these regions have been varied in a combinatorial manner. The substrate may then be processed through a next step that may be conventional or may also be a combinatorial step as discussed earlier with respect to FIG. 2.

Figure 4:
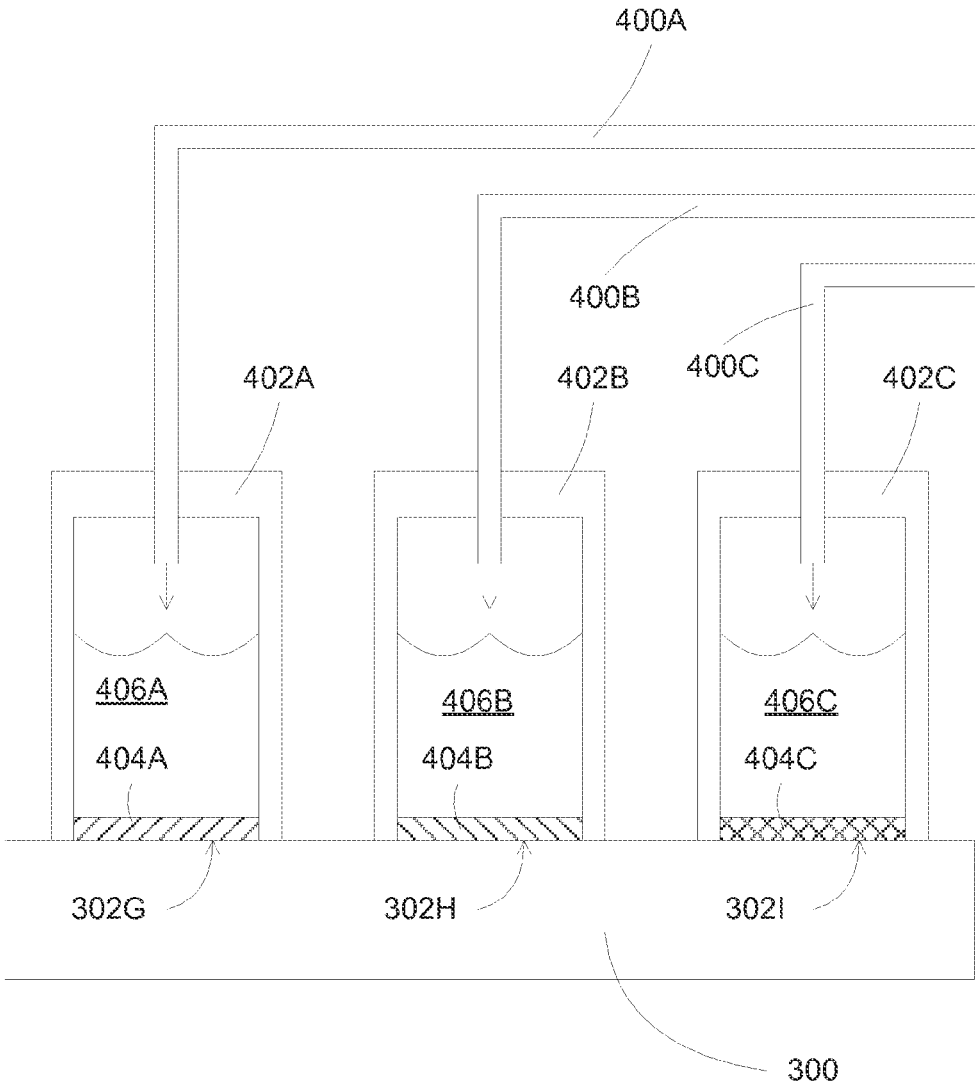
FIG. 4 illustrates a schematic diagram of a combinatorial wet processing system according to an embodiment described herein.

FIG. 4 illustrates a schematic diagram of a combinatorial wet processing system according to an embodiment described herein. A combinatorial wet system may be used to investigate materials deposited by solution-based techniques. An example of a combinatorial wet system is described in U.S. Pat. No. 7,544,574 cited earlier. Those skilled in the art will realize that this is only one possible configuration of a combinatorial wet system. FIG. 4 illustrates a cross-sectional view of substrate, 300, taken through the three site isolated regions, 302G-302I similar to the upper portion of FIG. 3. Solution dispensing nozzles, 400*a*-400*c*, supply different solution chemistries, 406A-406C, to chemical processing cells, 402A-402C. FIG. 4 illustrates the deposition of a layer, 404A-404C, on respective site isolated regions. Although FIG. 4 illustrates a deposition step, other solution-based processes such as cleaning, etching, surface treatment, surface functionalization, etc. may be investigated in a combinatorial manner. Advantageously, the solution-based treatment can be customized for each of the site isolated regions.

The manufacturing of advanced semiconductor devices can require substrate planarization. For example, photolithography process can pattern images at submicron line width, but require that the substrate be as flat as possible to enable optical focusing, since the depth of focus of the optical system is relatively small. One commonly used technique in semiconductor processing for planarizing the surface of a substrate is a polishing or chemical mechanical planarization (CMP) process, where the terms "planarization" and "polishing" are often used interchangeably.

The CMP process typically requires motion between the substrate surface and a polishing pad in the presence of a polishing slurry. Both mechanical planarization and chemical planarization processes are combined in a CMP process to produce a planar surface. For example, the relative motion of the substrate with respect to the polishing pad can produce mechanical abrasion, planarizing the surface. The slurry can react with the material on the substrate surface to produce chemical interaction, planarizing the surface.

The ability to conduct multiple experiments on a single substrate is generally desirable to evaluate new materials, chemicals, and processes, especially in advanced semiconductor processing. It would be advantageous to perform CMP processing on multiple site isolated regions on a substrate in a combinatorial manner.

Figure 5:
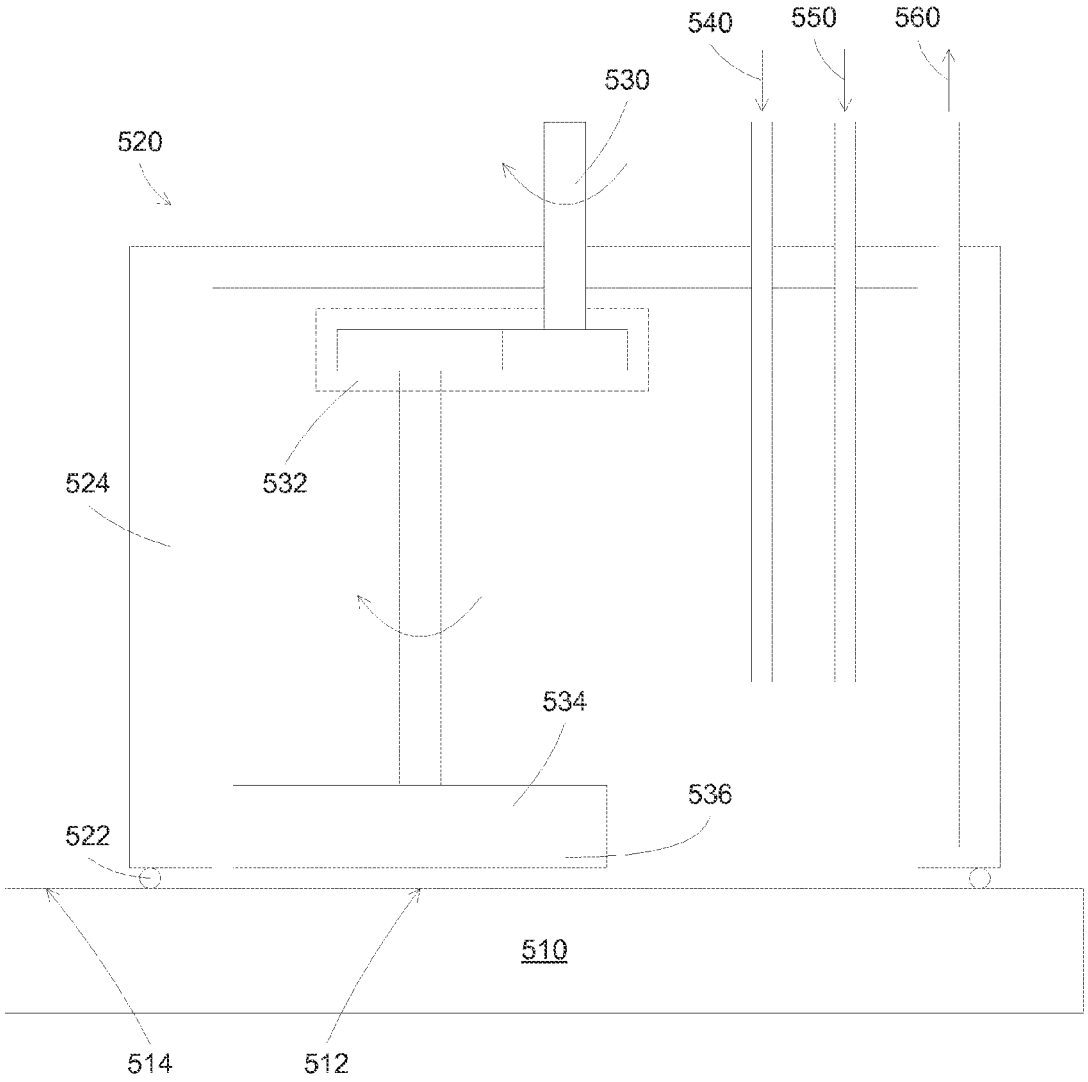
FIG. 5 illustrates a CMP reactor according to some embodiments of the present invention.

FIG. 5 illustrates a CMP reactor according to some embodiments of the present invention. A flow cell, e.g., a site isolated reactor 520 is disposed on a site isolated region 512 of a substrate 510. The chamber wall 524 of the reactor 520 can include a seal 522 to isolate the surface region 512 inside the reactor with the surface region 514 outside the reactor. An o-ring seal 522 is shown, but other forms of seal mechanism can be used, including non-contact seals, such as a gas bearing seal. A rotatable polishing head 534 is connected to a rotating axis 530 through a planetary gear 532. The polishing head 534 can include a polishing pad 536, configured to polish the surface 512 by a rotating mechanism while supplying a polishing fluid, e.g. slurry.

The planetary gear 532 allows the polishing head to rotate off center of the site isolated region 512, providing a uniform polishing surface. Alternatively, the polishing head can be coupled directly to the rotating axis 530, resulting in a center polishing action of the region 512.

The reactor 520 can further include a plurality of inlet and outlet conduits. For example, inlet conduit 550 can be coupled to a slurry distribution system to provide slurry to the reactor cell, which can assist the polishing head 534 in polishing the surface region 512. Inlet conduit 540 can be coupled to a chemical distribution system to provide chemicals, including deionized water, to the reactor cell. The chemicals can be used to clean or rinse the surface region 512 after CMP, including chemical rinsing and water rinsing. Outlet conduit 560 can be coupled to a vacuum exhaust to evacuate the materials within the reactor cell. The outlet conduit 560 is preferably disposed close to the substrate surface, and also within the reactor wall to avoid collision with the polishing head.

In operation, after the CMP reactor 520 is lowered on a substrate (or the substrate is raised to form a seal with the reactor), a CMP process is performed on the surface region 512 of the substrate within the interior volume of the reactor. A slurry is then delivered to the slurry conduit 550. The slurry flows onto the respective region 512 on the substrate 510, where it is restricted from flowing outward onto the surrounding surface portion of the substrate 510 by the seal 522. The polishing head is then lowered to the slurry surface, rotating to polish the surface region 512. The slurry can be supplied continuously, with excess materials being evacuated through the vacuum exhaust line 560.

After a predetermined amount of time, the rotation can stop, and the polishing head is raised from the surface region 512. Chemical rinsing, followed by water rinsing, can be performed, for example, through chemical supply conduit 540 and exhaust conduit 560. As such, the present invention allows for CMP processes to be performed on only particular portions of the substrate, without affecting any surface region outside the reactor 520.

Thus, in some embodiments, a substrate processing reactor is provided. The substrate processing reactor can include a reactor chamber including a chamber wall, wherein the chamber wall is disposed on a substrate surface to define a site isolated region on the substrate; a rotatable polishing head; a first conduit for distributing slurry to the site isolated region; a second conduit for distributing chemical to the site isolated region; and a third conduit for removing materials from the site isolated region. In some embodiments, the third conduit can be disposed within the chamber wall. The chamber wall contacts the substrate surface for forming a seal with the substrate surface. The chamber wall forms a non-contact seal with the substrate surface. In some embodiments, the reactor further includes a planetary gear system coupled to the polishing head.

Figure 6:
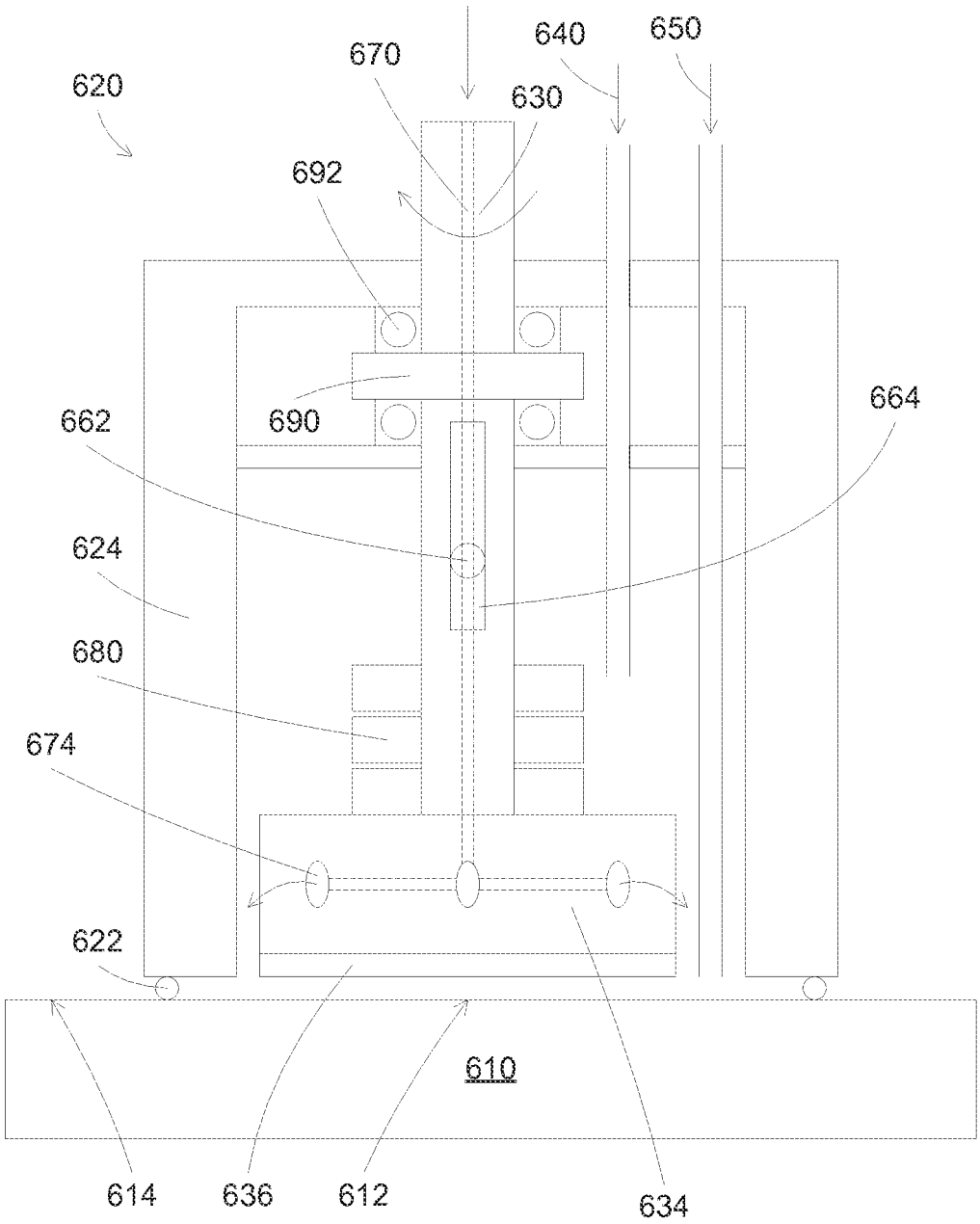
FIG. 6 illustrates another CMP reactor according to some embodiments of the present invention.

FIG. 6 illustrates another CMP reactor according to some embodiments of the present invention. A flow cell, e.g., a site isolated reactor 620 is disposed on a site isolated region 612 of a substrate 610. The chamber wall 624 of the reactor 620 can include a seal 622 to isolate the surface region 612 inside the reactor with the surface region 614 outside the reactor. A rotatable polishing head 634 is connected to a rotating shaft 630 through a gear set 690. The polishing head can be supported by bearing 692 for rotation. The polishing head can move up and down, for example, constrained by a pin 662 positioned in a slot 664. The polishing head 634 can include a polishing pad 636, configured to polish the surface 612 by a rotating mechanism while supplying a polishing fluid, e.g. slurry. The gear set 690 can couple the polishing head 634 directly to the rotating shaft 630, resulting in a center polishing action of the region 612.

The reactor 620 can further include multiple inlet and outlet conduits, including inlet conduit 650 coupled to a slurry distribution system and inlet conduit 640 coupled to a chemical distribution system. The chemicals can be used to clean or rinse the surface region 612 after CMP, including chemical rinsing and water rinsing. Additional conduits can be provided, such as a vacuum exhaust to evacuate the materials within the reactor cell. In some embodiments, a conduit 670 can be disposed in the polishing head, delivering slurry or chemicals through the openings 674. Particle solutions and chemical polishing or cleaning agents can be dispensed into the reactor via the hollow interior of the shaft, and removed via the exhaust tubes of the reactor assembly.

In some embodiments, a downward force can be provided to the polishing head. Multiple weight rings 680 can be positioned on the polishing head to exert a force on the polishing surface 612. The rotating shaft can be attached to a reactor, such that the shaft extends into the interior of the reactor and contacts the surface of a site isolated region on a substrate. The downward pressure of the shaft and the polishing pad on the surface of the site isolated region can be controlled by gravity, e.g., weighted rings, added to the shaft above the pad area, or by an internal spring-loading system with adjustable shaft length and/or spring tension.

Figure 7A:
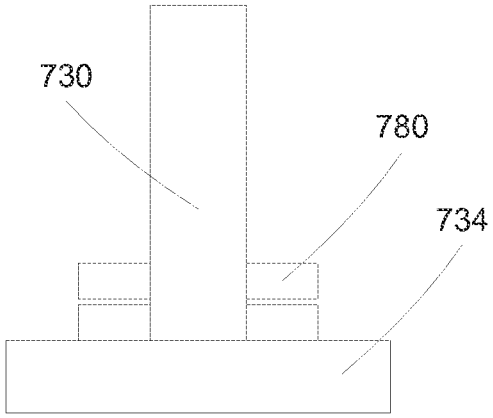
FIGS. 7A-7D illustrate various configurations for applying a downward force to the polishing head according to some embodiments of the present invention.

FIGS. 7A-7D illustrate various configurations for applying a downward force to the polishing head according to some embodiments of the present invention. In FIG. 7A, multiple weight rings 780 can be provided around rotating shaft 730, helping to exert a force on the polishing head 734. The weight rings can completely surround the rotating shaft. The weight rings can include multiple components, which are coupled together around the rotating shaft. The number of weight rings installed on a rotating head can be varied, for example, to optimize the force during the polishing or cleaning process.

Figure 7B:
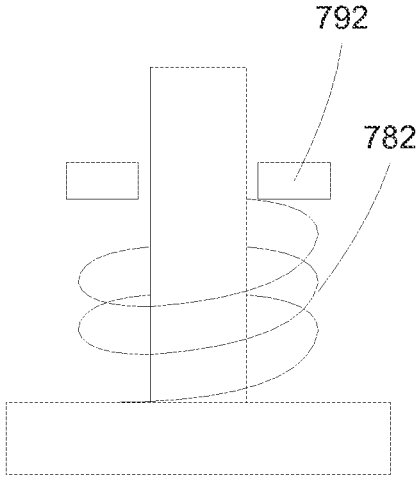
Figure 7C:
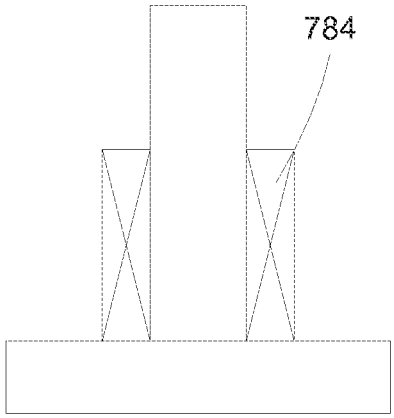
Figure 7D:
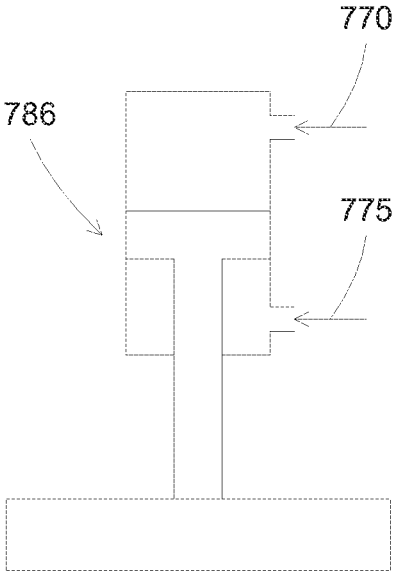

In FIG. 7B, a spring 782 can be used to provide the force to the polishing head. An adjustment mechanism 792 can be included to change the force exerted by the spring to the polishing head. In FIG. 7C, electromagnet 784 can be used. The power to the electromagnet can be changed to vary the force on the polishing head. In FIG. 7D, a pneumatic cylinder 786 can be used to provide a pneumatic force to the polishing head. Gas pressure 770 and 775 can be applied to the inlet and outlet of the pneumatic cylinder 786 to regulate the pneumatic force. For example, an increase or decrease in air pressure 770 can increase or decrease the pneumatic force acting on the polishing head, respectively. Similarly, an increase or decrease in air pressure 775 can decrease or increase the pneumatic force acting on the polishing head, respectively. Other configurations can be used, such as a hydraulic force using liquid pressure instead of pneumatic force using air pressure.

In some embodiments, the present invention discloses CMP processes using site isolated reactors. With the reactors defining the site isolated regions, the substrate is stationary while the polishing head rotates. In addition, the chamber wall of the reactor can confine the isolated region, allowing cleaning or rinsing of the polishing area. The chamber wall can be cleaned during the cleaning of the site isolated region.

During the CMP process, abrasive slurry can be flowed or dropped onto the site isolated region, which can cause splashes, forming residues that scatter and stick to the chamber wall. The residues then can fall off to the polishing surface, creating scratch defects. Thus, in some embodiments, the chamber wall is periodically cleaned to wash off the slurry.

In some embodiments, the present invention discloses systems and methods for combinatorially polishing and evaluating multiple site isolated regions on a substrate. Multiple CMP reactors can be used to process multiple site isolated regions on a single substrate. Different site isolated regions can have different downward forces, allowing the evaluation of optimized conditions for processing the substrate.

In some embodiments, the present invention discloses a combinatorial system for CMP processing. A system includes a substrate support for supporting a substrate; multiple reactors, wherein each reactor includes a chamber wall, wherein the chamber wall is disposed on the substrate surface to define a site isolated region on the substrate; a rotatable polishing head, wherein each rotatable head can have a different downward force; a number of conduits for distributing slurry and chemicals to the site isolated region; and a conduit for removing materials from the site isolated region. The multiple reactors can process the site isolated regions in a combinatorial manner.

Figure 8:
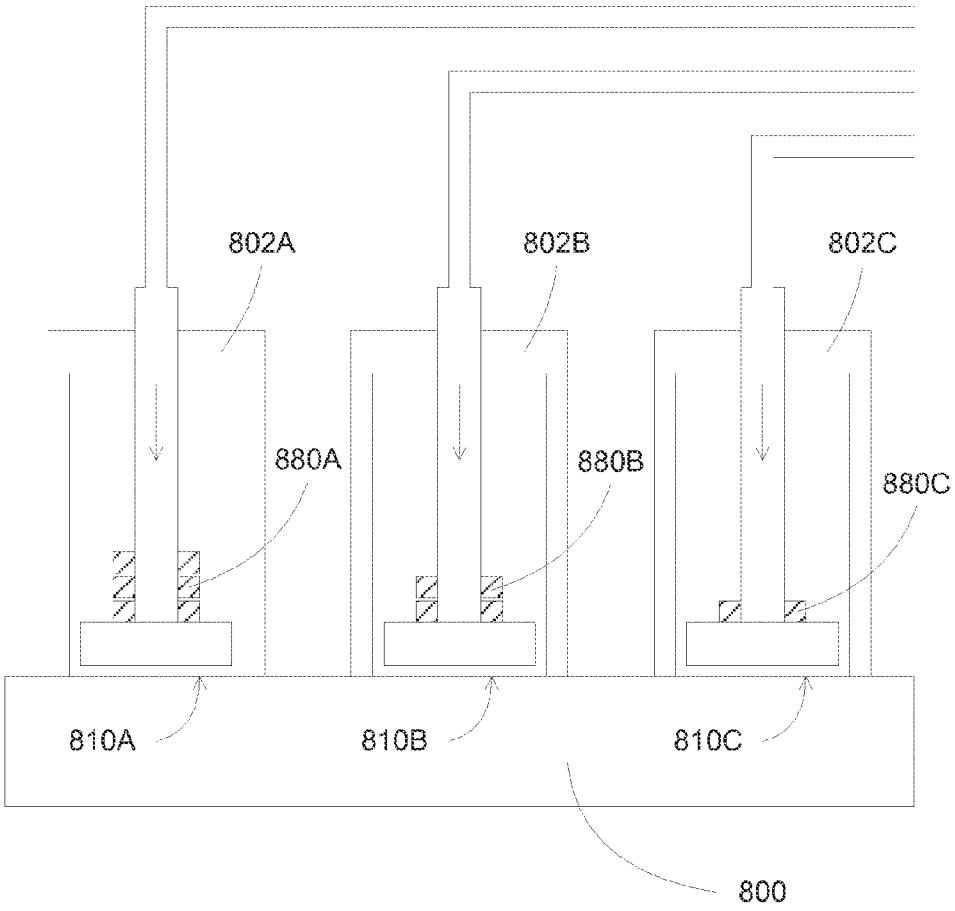
FIG. 8 illustrates a schematic diagram of a combinatorial polishing and cleaning processing system according to some embodiments of the present invention.

FIG. 8 illustrates a schematic diagram of a combinatorial polishing and cleaning processing system according to some embodiments of the present invention. Three site isolated regions 810A-810C are formed on a substrate 800 by three reactors 802A-802C. Slurry and chemicals can be supplied to the reactors, with rotatable heads polishing or cleaning the site isolated regions. Different slurry and chemical solutions can be used for a combinatorial evaluation of the polishing or cleaning process. In addition, different downward forces, for example, by using different number of weight rings 880A-880C on the rotatable heads, can be combinatorially used for optimizing the process.

In some embodiments, removable and exchangeable polishing heads can be used for combinatorially evaluating the site isolated regions. Removable polishing pads or removable polishing heads can be used for coupling with the rotating shafts.

Figure 9A:
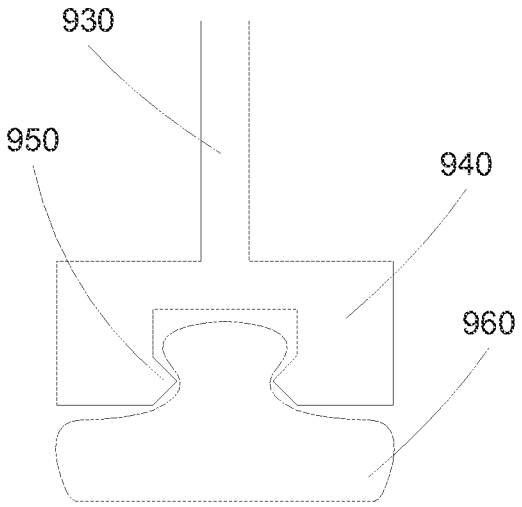
FIGS. 9A-9B illustrate cross section views of removable polishing heads according to some embodiments of the present invention.
Figure 9B:
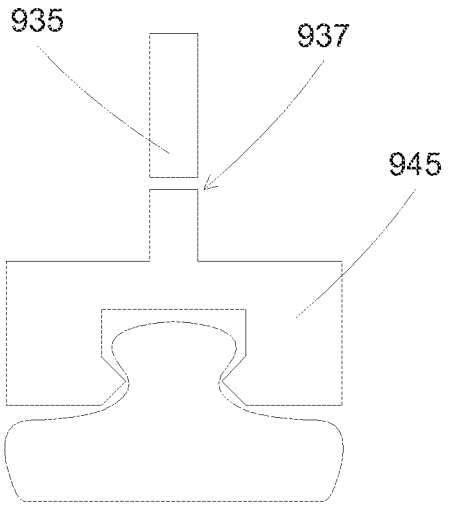

FIGS. 9A-9B illustrate cross section views of removable polishing heads according to some embodiments of the present invention. In FIG. 9A, a polishing head can include a support head 940 directly connected to a rotating shaft 930. A removable polishing pad 960 can be coupled to the support head 940. For example, the support head can include a retaining feature 950, which can retain the polishing pad 960. The polishing pad 960 can include a deformable material, such as a foam material, that can be squeezed and retained in the support head 940 by the retaining feature 950. In FIG. 9B, the support head 945 can be detachable from the rotating shaft 935, for example, through a coupling mechanism 937.

Figure 10A:
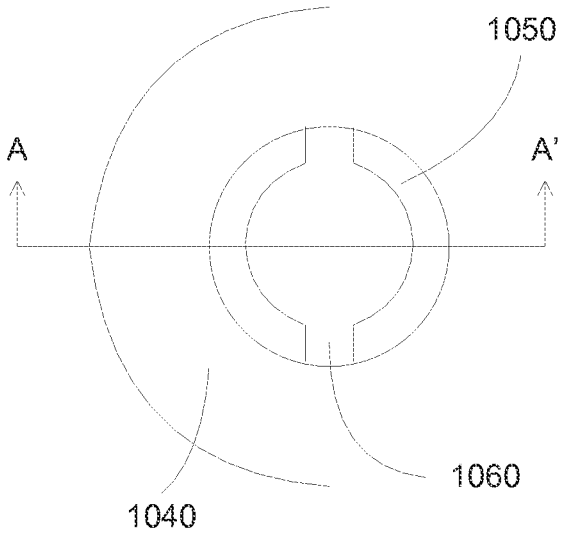
FIGS. 10A-10C illustrate a retaining feature according to some embodiments of the present invention.
Figure 10B:
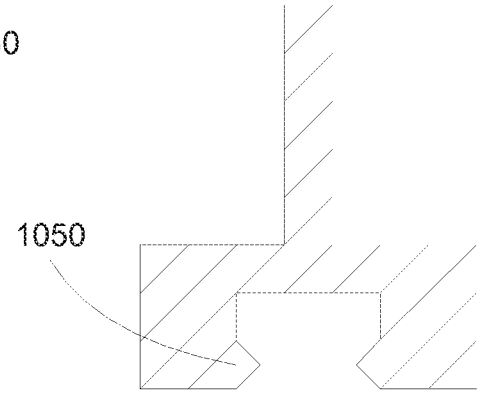
Figure 10C:
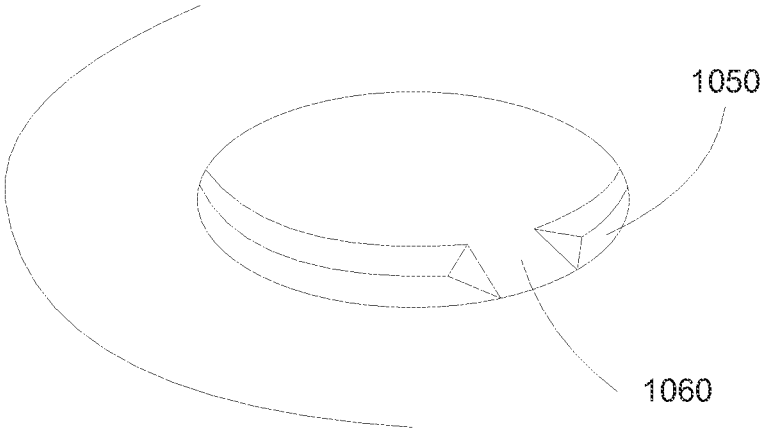

FIGS. 10A-10C illustrate a retaining feature according to some embodiments of the present invention. FIG. 10A shows a bottom view of a retaining feature. FIG. 10B shows a cross section view of the same retaining feature. FIG. 10C shows a perspective view of the same retaining feature. A support head 1040 can have a recess for retaining the polishing pad. The recess can have a sharp edge 1050 for catching on the polishing head. An opening 1060 can be included for ease of installation of the polishing pad in the support head.

Figure 11A:
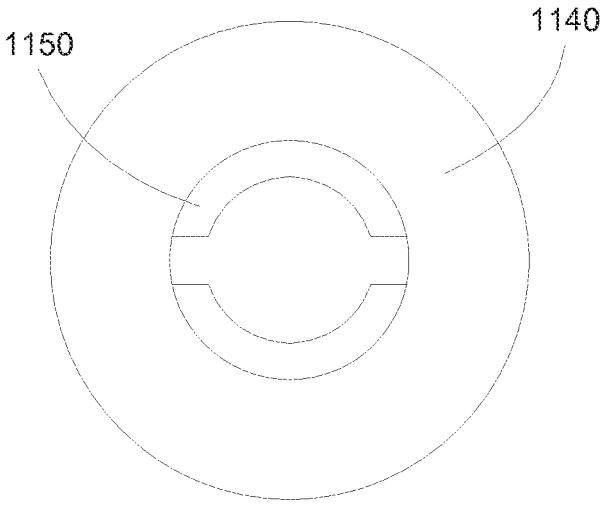
FIGS. 11A-11B illustrate different configurations of the retaining feature according to some embodiments of the present invention.
Figure 11B:
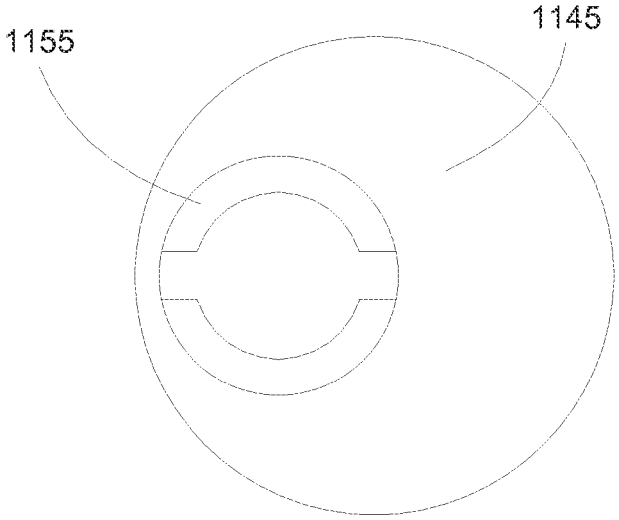

FIGS. 11A-11B illustrate different configurations of the retaining feature according to some embodiments of the present invention. In FIG. 11A, the retaining feature 1150 can be positioned concentric with the support head 1040. In FIG. 11B, the retaining feature 1155 can be positioned with an offset with the support head 1045.

In some embodiments, the pad material can be interchangeable and can include materials appropriate for a variety of applications. For example, polyurethane for chemical mechanical planarization (CMP), or poly(vinyl alcohol) for cleaning and particle removal.

In some embodiments, the present invention discloses polishing systems and methods in which the polishing area is the same as the area of the polishing pad. For example, the substrate can be stationary and the polishing head rotates on its own axis. Alternatively, the substrate and the polishing head can be concentric and can rotate on their own axis.

In some embodiments, the present invention discloses polishing pads having channels for re-distributing chemical and slurry to the polishing area. Since the polishing area is fixed, the rotational movement of the polishing head can drive away the slurry and chemical. The channels can capture the chemical and slurry back to the polishing area.

Figure 12A:
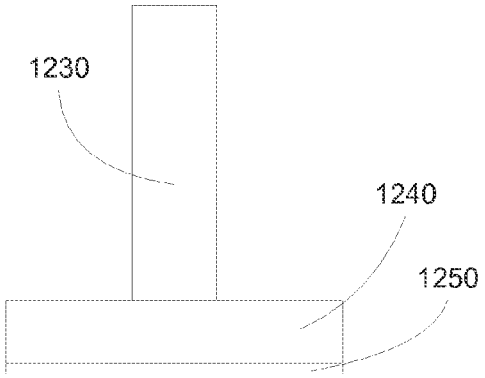
FIGS. 12A-12C illustrate a polishing head according to some embodiments of the present invention.
Figure 12B:
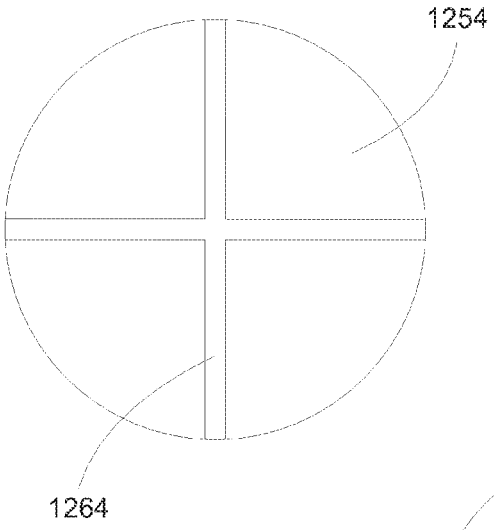
Figure 12C:
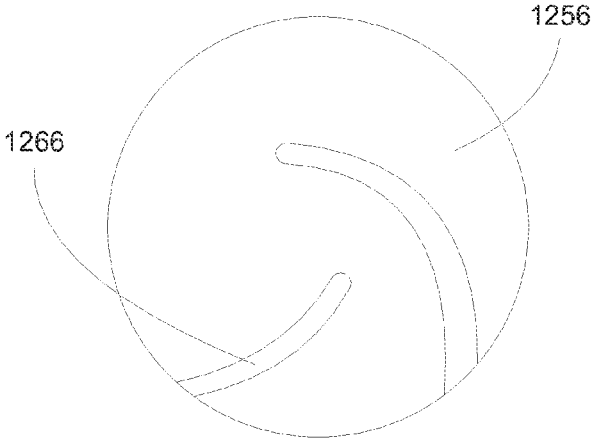

FIGS. 12A-12C illustrate a polishing head according to some embodiments of the present invention. FIG. 12A shows a side view of a polishing head, including a polishing head 1240 coupled to a rotating shaft 1230. A polishing pad 1250 can adhere to the bottom of the polishing head 1240. As shown, the polishing head includes direct coupling between the polishing pad, the polishing head and the rotating shaft. Other configurations can be used, such as a removable support head coupled to the rotating shaft, or a removable polishing pad coupled to the support head by a retaining feature.

In some embodiments, the surface of the pad contacting the substrate surface may be customized for specific applications. For example, channels can be included in the pad surface to allow exposure of the substrate to cleaning chemistry, mimicking the situation in a post-CMP cleaning tool ("brush-box").

FIGS. 12B and 12C show a bottom view of different polishing pads 1254 and 1256 having channels 1264 and 1266, respectively. Channels 1264 form straight lines through the center of the pad. Channels 1266 form curved lines, leading from an inner area of the pad to the outer edge of the pad. Other channel configurations can also be used, such as curved lines through the center of the pad, or straight lines from an inner area of the pad to the outer edge of the pad. During the rotation of the polishing pads, slurry and chemical can enter the channels, re-coating the polishing surface. Thus the channels can allow slurry and chemical to be present under the polishing pads during the rotating action. In some embodiments, the channels can form an acute angle with the normal direction of the polishing pad, thus attracting slurry and chemical during the rotation of the polishing pad.

In some embodiments, the present invention discloses methods, using the above described polishing systems, for combinatorially polishing site isolated regions of a substrate.

Figure 13:
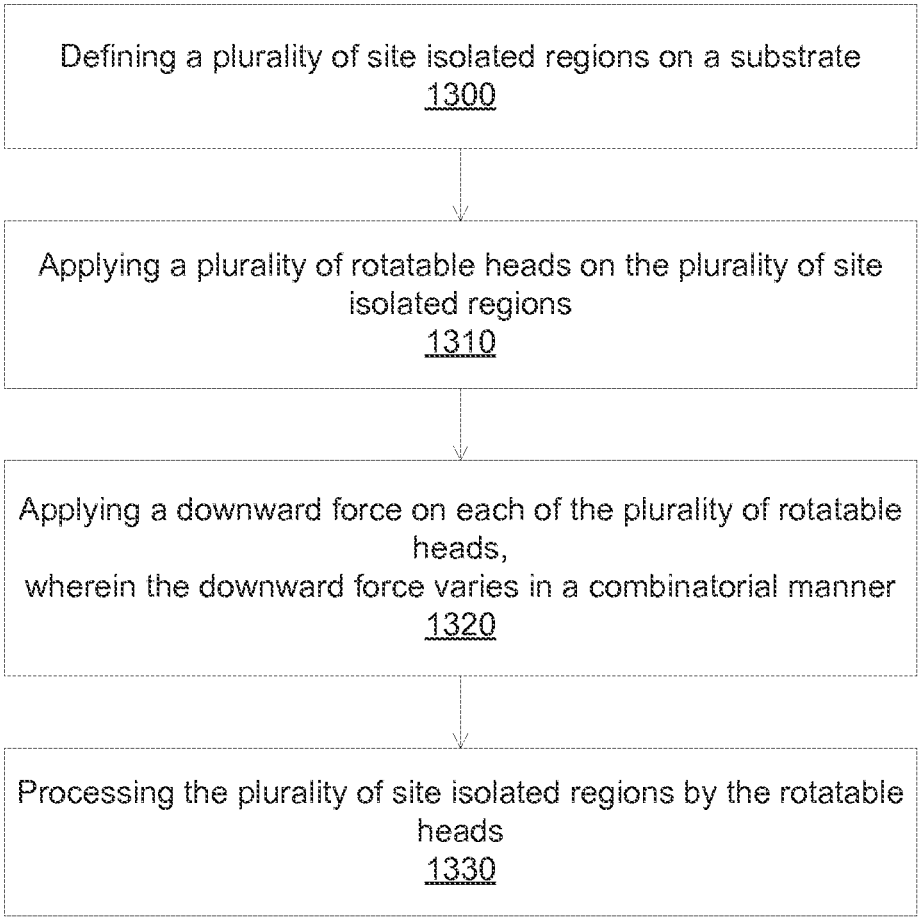
FIG. 13 illustrates a flowchart for polishing site isolated regions according to some embodiments of the present invention.

FIG. 13 illustrates a flowchart for polishing site isolated regions according to some embodiments of the present invention. Operation 1300 defines multiple isolated regions on a substrate. Operation 1310 applies multiple rotatable polishing heads on the multiple site isolated regions. Operation 1320 applies a downward force on the multiple polishing heads. Operation 1330 processes the multiple site isolated regions by the polishing heads.

In some embodiments, the method can further include wetting the isolated region; lowering a rotatable polishing head on the wetted isolated region; polishing an area of the isolated region while flowing slurry on another area of the isolated region; flowing a liquid to the isolated region for rinsing; and exhausting the liquid from the isolated region.

In some embodiments, parameters and process conditions for optimizing polishing and cleaning processes can be evaluated. The pressure of each pad of each reactor can be individually adjustable, allowing for combinatorial testing of different mechanical down-force in particle deposition, polishing and cleaning applications. For example, the downward force or pressure can vary in a combinatorial manner between multiple reactors in a reactor assembly. The attachment of different pad types allows for the combinatorial testing of different materials and pad designs for particle deposition, polishing, and cleaning. The dispensing of different particle solutions, slurry formulations, and other chemical solutions (e.g. those containing organic compounds or defect sources) into the reactors allows for combinatorial testing of the residues resulting from depositions of these chemistries and formulations—as is relevant in, for example, CMP-related applications. The dispensing of different cleaning chemistries into reactor cells allows for combinatorial testing of surface cleaning—as is relevant in Post-CMP cleaning and other general semiconductor cleaning applications.

Although the foregoing examples have been described in some detail for purposes of clarity of understanding, the invention is not limited to the details provided. There are many alternative ways of implementing the invention. The disclosed examples are illustrative and not restrictive.

What is claimed is:

1. A processing reactor for chemical mechanical polishing (CMP) in a combinatorial manner, the reactor comprising a reactor chamber comprising a chamber wall, wherein the chamber wall is disposed on a substrate surface to define a site isolated region on the substrate;

a rotatable head comprising a support head and a polishing pad coupled to the support head using a recess in the support head having a sharp edge for catching on to and retaining a portion of the polishing pad protruding into the recess, wherein the recess is positioned concentric with a rotating axis of the support head, wherein the polishing pad comprises a deformable material allowing the portion of the polishing pad to be inserted into the recess in the support head past the sharp edge;

wherein the polishing pad comprises one or more channels for re-distributing chemicals or slurry to an inner area of the pad;

a first conduit for distributing chemicals to the site isolated region; and a second conduit for removing materials from the site isolated region.

2. The reactor of claim 1 wherein the one or more channels comprise straight lines through the center of the polishing pad.

3. The reactor of claim 1 wherein the one or more channels comprise curved lines to the outer edge of the polishing pad.

4. The reactor of claim 1 further comprising a mechanism for applying a downward force on the rotatable head, wherein the downward force is adjustable.

5. The reactor of claim 4 wherein the mechanism comprises multiple weight rings coupled to the rotatable head.

6. The reactor of claim 4 wherein the mechanism comprises an adjustable spring coupled to the rotatable head.

7. The reactor of claim 4 wherein the mechanism comprises an electromagnet coupled to the rotatable head.

8. The reactor of claim 1 wherein the rotatable head is connected to a rotating shaft through a planetary gear set.

9. The reactor of claim 1 wherein the recess is positioned with an offset with a rotating axis of the support head.

10. The reactor of claim 2 wherein the polishing pad comprises polyurethane for chemical mechanical planarization.

11. The reactor of claim 2 wherein the polishing pad comprises polyvinyl alcohol for cleaning and particle removal.

12. A processing system for chemical mechanical polishing (CMP) in a combinatorial manner, the system comprising a substrate support for supporting a substrate;

a plurality of reactors, wherein each of the plurality of reactors is disposed on a different portion of a surface of the substrate to define a plurality of site isolated regions on the substrate, and wherein each of the plurality of site isolated regions is associated with a different one of the plurality of reactors;

a plurality of rotatable heads, wherein each of the plurality of rotatable heads comprises a support head and a polishing pad coupled to the support head using a recess in the support head having a sharp edge for catching on to and retaining a portion of the polishing pad protruding into the recess, wherein the recess is positioned concentric with a rotating axis of the support head, wherein the polishing pad comprises a deformable material allowing the portion of the polishing pad to be inserted into the recess in the support head past the sharp edge;

wherein the polishing pad comprises one or more channels for re-distributing chemicals or slurry to an inner area of the pad, wherein each reactor of the plurality of reactors comprises a different rotatable head in the plurality of rotatable heads, and wherein each different rotatable head is operable to polish or clean the each site isolated region defined by the each reactor associated therewith;

a plurality of mechanisms, wherein each mechanism in the plurality of mechanisms is configured to apply a downward force to an associated rotatable head, and wherein the downward force applied by the each mechanism varies from that of all other mechanisms in the plurality of mechanisms in a combinatorial manner;

a plurality of first conduits, wherein one or more first conduits in the plurality of first conduits are configured for distributing chemicals to a single site isolated region;

a plurality of second conduits, wherein one or more second conduits in the plurality of second conduits are configured for removing materials from the single site isolated region.

13. The system of claim 12 wherein the each mechanism comprises multiple weight rings coupled to the associated rotatable head.

14. The system of claim 12 wherein the each mechanism comprises an adjustable spring coupled to the associated rotatable head.

15. The system of claim 12 wherein the each mechanism comprises an electromagnet coupled to the associated rotatable head.

* * * * *